US008319655B2

(12) United States Patent
Mao

(10) Patent No.: US 8,319,655 B2
(45) Date of Patent: Nov. 27, 2012

(54) REWRITING APPARATUS CONTROL CIRCUIT

(75) Inventor: Hai-Rong Mao, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 1318 days.

(21) Appl. No.: 12/033,872

(22) Filed: Feb. 19, 2008

(65) Prior Publication Data

US 2009/0160827 A1 Jun. 25, 2009

(30) Foreign Application Priority Data

Dec. 24, 2007 (CN) ..... 2007 1 0203372

(51) Int. Cl.
*G09F 9/00* (2006.01)

(52) U.S. Cl. ..... 340/815.44; 235/128; 345/34; 711/167; 360/53

(58) Field of Classification Search ..... 340/815.4, 340/815.44; 345/34; 235/128; 386/56; 711/155, 711/166, 167; 360/53
See application file for complete search history.

(56) References Cited

U.S. PATENT DOCUMENTS

| | | | | |
|---|---|---|---|---|
| 5,481,274 | A * | 1/1996 | Aratani et al. | 345/98 |
| 6,690,366 | B1 * | 2/2004 | Kitahashi | 345/211 |
| 7,126,569 | B2 * | 10/2006 | Ootsuka et al. | 345/87 |
| 2002/0180999 | A1 * | 12/2002 | Kanai | 358/1.9 |
| 2009/0160827 | A1 * | 6/2009 | Mao | 345/204 |

* cited by examiner

*Primary Examiner* — George Bugg
*Assistant Examiner* — Edny Labbees
(74) *Attorney, Agent, or Firm* — Altis Law Group, Inc.

(57) ABSTRACT

A rewriting apparatus control circuit includes a display system and a processor. The processor includes a first input terminal receiving a rewriting complete signal from the rewriting apparatus; a second input terminal receiving a rewriting success signal from the rewriting apparatus; an output terminal connecting to the rewrite apparatus for sending a restarting signal; and data terminals connected to the display system. Once the rewriting complete signal from the rewriting apparatus is received, the processor subtracts one for each restarting sent from a preset number and then sends a result to the display system for displaying and sends the restarting signal to the rewriting apparatus for restarting the rewriting apparatus if the result is greater than zero. The processor accumulates a number of times that the rewriting success signal is received from the rewriting apparatus, and sends the number to the display system for displaying when the result is zero.

10 Claims, 1 Drawing Sheet

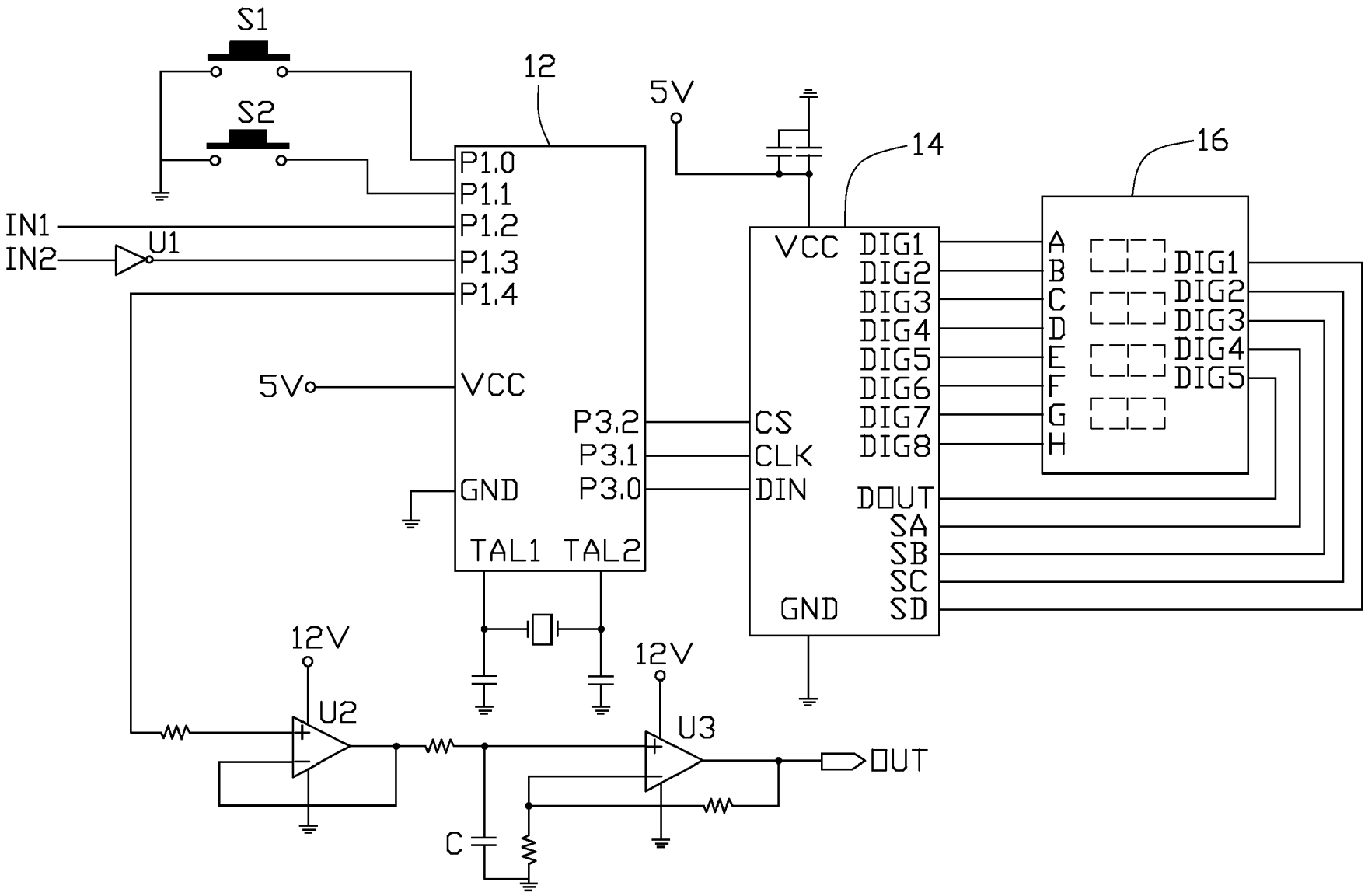
16
DIG1
DIG2
DIG3
DIG4
DIG5
A
B
C
D
E
F
G
H
14
DIG1
DIG2
DIG3
DIG4
DIG5
DIG6
DIG7
DIG8
DOUT
SA
SB
SC
SD
VCC
GND
CS
CLK
DIN
5V
12
P1.0
P1.1
P1.2
P1.3
P1.4
VCC
GND
P3.2
P3.1
P3.0
TAL2
TAL1
12V
U3
OUT
C
12V
U2
5V
S1
S2
U1
IN1
IN2

REWRITING APPARATUS CONTROL CIRCUIT

BACKGROUND

1. Field of the Invention

The present invention relates to control circuits, and particularly to a rewriting apparatus control circuit.

2. Description of Related Art

Conventionally, a rewriting apparatus is used to rewrite integrated circuits (ICs) (such as BIOS) for testing stability of the ICs. When the rewriting apparatus completes rewriting of an IC, the rewriting apparatus sends a rewriting complete signal to turn on a first light emitting diode (LED) for indicating that rewriting is complete. The rewriting apparatus further generates a rewriting success signal to turn on a second LED for showing that the rewriting is successful once rewriting is successfully completed. Operators usually need to press a power button of the rewriting apparatus for turning it on to rewrite ICs, which is inconvenient and time consuming for operators, because it is common to power up the rewriting apparatus about a thousand times.

SUMMARY

An exemplary rewriting apparatus control circuit includes a display system and a processor. The processor includes a first input terminal arranged to receive a rewriting complete signal from the rewriting apparatus; a second input terminal arranged to receive a rewriting success signal from the rewriting apparatus; an output terminal arranged to connect to the rewrite apparatus for sending a restarting signal; and a plurality of data terminals connected to the display system. Once receiving the rewriting complete signal from the rewriting apparatus, the processor subtracts one for each restarting signal sent from a preset number and then sends a result to the display system for displaying and sends the restarting signal to the rewriting apparatus for restarting the rewriting apparatus if the result is greater than zero. The processor accumulates a number of times that the rewriting success signal is received from the rewriting apparatus, and sends the number to the display system for displaying when the result is zero.

Other advantages and novel features of the present invention will become more apparent from the following detailed description of preferred embodiment when taken in conjunction with the accompanying drawing, in which:

BRIEF DESCRIPTION OF THE DRAWINGS

The drawing is a circuit diagram of a rewriting apparatus control circuit in accordance with the present invention.

DETAILED DESCRIPTION

Referring to the drawing, a rewriting apparatus control circuit for a rewriting apparatus in accordance with an embodiment of the present invention includes a processor 12 and a display system. The processor 12 comprises a power terminal VCC connected to a 5V power source, a ground terminal GND, a first input terminal P1.2 arranged to receive a rewriting complete signal IN1 from the rewriting apparatus, a second input terminal P1.3 arranged to receive a rewriting success signal IN2 via a NOT gate U1 from the rewriting apparatus (the first and second input terminals P1.2 and P1.3 are enabled at a high voltage level, but the rewriting success signal IN2 is at a low level), an output terminal P1.4 arranged to connect to the rewrite apparatus via a filter circuit for sending a restarting signal OUT, three data terminals P3.0~P3.2 connected to the display system, and two frequency terminals TAL1 and TAL2. A crystal is connected between the frequency terminals TAL1 and TAL2 of the processor 12 for providing working cycles (clocking).

The filter circuit comprises two comparators U2 and U3 connected in series, and a capacitor C having an end connected to a node between the two comparators U2 and U3 and an opposite end grounded. The output terminal P1.4 is connected to the non-inverting input terminal of the comparator U2, the inverting input terminal of the comparator U2 is connected to the output terminal thereof, and the output terminal of the comparator U2 is connected to the non-inverting input terminal of the comparator U3. The inverting input terminal of the comparator U3 is connected to the output terminal thereof and grounded, and the output terminal of the comparator U3 is connected to the rewrite apparatus for sending the restarting signal. A voltage of the restarting signal OUT can be adjusted by adjusting a capacitance of the capacitor C.

The display system comprises a controller 14 and a seven-segment numeric LED display 16. The controller 14 comprises a power terminal VCC connected to the 5V power source, a ground terminal GND grounded, three data terminals CS, CLK, and DIN, eight data output terminals DIG1~DIG8, and five control terminals SA~SD and DOUT. The data terminals CS, CLK, and DIN are connected to three data terminals P3.2, P3.1, and P3.0 of the processor 12 respectively. The data terminal P3.2 of the processor 12 is arranged to send an enable signal to the controller 14 for turning on the controller 14. The data terminal P3.1 of the processor 12 is arranged to provide working cycles to the controller 14. The data terminal P3.0 of the processor 12 is arranged to transmit data generated by the processor 12. The seven-segment numeric LED display 16 comprises eight data input terminals A~H connected to the data output terminal DIG1~DIG8 of the controller 14 respectively, and five control terminals DIG5~DIG1 connected to the control terminals DOUT and SA~SD of the controller 14 respectively.

Once the processor 12 receives the rewriting complete signal IN1 from the rewriting apparatus, the processor 12 subtracts one for each restarting signal sent from a preset number and then sends a result to the controller 14 via the data terminal P3.0 and sends the restarting signal OUT to the rewriting apparatus for restarting the rewriting apparatus if the result is greater than zero. The processor 12 accumulates a number of times that the rewriting success signal IN2 is received from the rewriting apparatus and sends the number to the controller 14 for displaying by the LED display 16 when the result is zero.

Therefore, the rewriting apparatus can be restarted by the processor 12 for a certain times equals to the preset number, and the LED display 16 will display a remaining number of times that the rewriting apparatus should be restarted by the processor 12, and display the number of times that the rewriting success signal IN2 is generated by the rewriting apparatus when the number that the rewriting apparatus should be restarted by the processor 12 is zero.

In this embodiment of the invention, the processor 12 further comprises two presetting terminals P1.0 and P1.1 grounded via two switches S1 and S2 respectively. The preset number can be adjusted by operating the switches S1 and S2.

The foregoing description of the exemplary embodiments of the invention has been presented only for the purposes of illustration and description and is not intended to be exhaustive or to limit the invention to the precise forms disclosed.

Many modifications and variations are possible in light of the above teaching. The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A rewriting apparatus control circuit for a rewriting apparatus comprising:

a display system; and a processor comprising:

a first input terminal arranged to receive a rewriting complete signal from the rewriting apparatus once the rewriting apparatus completes a rewriting process;

a second input terminal arranged to receive a rewriting success signal from the rewriting apparatus once the rewriting apparatus has successfully completed a rewriting process;

an output terminal arranged to connect to the rewrite apparatus for sending a restarting signal; and at least a data terminal connected to the display system for transmitting data, wherein the processor subtracts one for each restarting signal sent from a preset number and then sends a result to the display system for displaying and sends the restarting signal to the rewriting apparatus for restarting the rewriting apparatus if the result is greater than zero, once the processor receives the rewriting complete signal from the rewriting apparatus; and the processor accumulates a number of times that the rewriting success signal is received from the rewriting apparatus, and sends the number to the display system for displaying when the result is zero.

2. The rewriting apparatus control circuit as claimed in claim 1, wherein the processor further comprises two presetting terminals grounded via two switches respectively, the switches are operated to adjust the preset number.

3. The rewriting apparatus control circuit as claimed in claim 1, wherein the output terminal of the rewriting apparatus control circuit is connected to the rewriting apparatus via a filter circuit.

4. The rewriting apparatus control circuit as claimed in claim 3, wherein the filter circuit comprises two comparators connected in series, and a capacitor having an end connected to a node between the two comparators and an opposite end grounded.

5. The rewriting apparatus control circuit as claimed in claim 4, wherein the non-inverting input terminal of one of the comparators is connected to the output terminal of the processor, the inverting input terminal of the one of the comparators is connected to the output terminal thereof, the output terminal of the one of the comparators is connected to the non-inverting input terminal of another one of the comparators, the inverting input terminal of the another one of the comparators is connected to the output terminal thereof and grounded, and the output terminal of the another one of the comparators is connected to the rewrite apparatus for sending the restarting signal.

6. The rewriting apparatus control circuit as claimed in claim 5, wherein the capacitor is connected between the output terminal of the one of the comparators and ground.

7. The rewriting apparatus control circuit as claimed in claim 1, wherein the display system comprises a controller and a seven-segment numeric LED display, the controller is connected between the LED display and the processor.

8. The rewriting apparatus control circuit as claimed in claim 7, wherein the controller comprises eight data output terminals and five selection terminals, and the LED display comprises eight data input terminals connected to the data output terminals of the controller respectively and five control terminals connected to the five selection terminals of the controller respectively.

9. The rewriting apparatus control circuit as claimed in claim 8, wherein the processor further comprises two frequency terminals, a crystal is connected between the frequency terminals of the processor for providing working cycles.

10. The rewriting apparatus control circuit as claimed in claim 9, wherein the processor sends the working cycles to the controller.

* * * * *